US005903093A

United States Patent [19]

Seiler et al.

[11] Patent Number: 5,903,093

[45] Date of Patent: May 11, 1999

[54] DISCHARGE LAMP, IN PARTICULAR FOR VEHICLE ILLUMINATION DEVICES, WITH BURNER AND DISCHARGE VESSEL

[75] Inventors: Hartmut Seiler, Baden-Baden; Bernhard Woerner; Ralf Kramp, both of Reutlingen; Ingo Gorille, Oberriexingen, all of Germany

[73] Assignee: Robert Bosch GmbH, Stuttgart, Germany

[21] Appl. No.: 08/942,080

[22] Filed: Oct. 1, 1997

[30] Foreign Application Priority Data

Oct. 2, 1996 [DE] Germany ..... 196 40 666

[51] Int. Cl.[6] ..... H01J 5/48

[52] U.S. Cl. ..... 313/318.01; 313/25; 313/623

[58] Field of Search ..... 313/318.01, 318.07, 313/623, 634, 635, 25, 26

[56] References Cited

FOREIGN PATENT DOCUMENTS 43 19 467 A1 1/1994 Germany .

*Primary Examiner*—Sandra O'Shea
*Assistant Examiner*—Matthew J. Gerike
*Attorney, Agent, or Firm*—Michael J. Striker

[57] ABSTRACT

A discharge lamp has a base with a burner having a discharge vessel with at least two electrodes and a supply conductor extending from the base to one electrode as well as a return conductor extending from the other electrode to the base, wherein the supply conductor is surrounded in the burner by a glass tube while the return conductor extends outside the burner along it, and between the surface of the supply conductor and an inner surface of the glass tube a distance is formed by an air-filled space and retained as low as possible or preferably at least approximately zero, so that the intensity of an electrical field formed between the supply conductor and the return conductor is low and the return conductor can be guided along near the burner, which makes possible a compact construction of the discharge lamp or the use of a high ignition voltage for the discharge lamp and/or its operation at high altitudes without the danger of partial discharges in the glass tube or ark-overs outside the discharge vessel.

22 Claims, 8 Drawing Sheets

DISCHARGE LAMP, IN PARTICULAR FOR VEHICLE ILLUMINATION DEVICES, WITH BURNER AND DISCHARGE VESSEL

BACKGROUND OF THE INVENTION

The present invention relates generally to discharge lamps, in particular for vehicle illumination devices.

Discharge lamps of the above mentioned general type are known in the art. One of such discharge lamps is disclosed in the German patent document DE 43 19467 A1. This discharge lamp has a base and a burner connected with it. The burner has a discharge vessel with two electrodes which form a light arc during the operation of the discharge lamp. The electrodes are connected correspondingly with the electrical conductors. One electrode is connected with a supply conductor in the burner which is surrounded by a glass tube, while another electrode is connected with a return conductor which is located outside of the burner and extend along the burner to the base. The burner is mechanically connected with the base by the glass tube surrounding the supply conductor, and therefore the glass tube must have a sufficiently large cross-section, to reliably hold the burner. Also, constructions of discharge lamps are known in which the mounting of the burner is performed through a glass tube which surrounds it. Here however the inner glass tube must have a sufficiently large cross-section, so that the discharge vessel can be formed from it. An air-filled space remains between the surface of the supply conductor and the inner surface of the glass tube.

In order to provide a compact construction of the discharge lamp including the base, it is desirable to guide the returned conductor as close as possible on the glass tube to the base. For actuating the discharge lamp, it must be ignited, and for this purpose high frequency high voltage is applied through the conductors to the electrodes and can reach several tens kilovolt. It must be guaranteed that it does not lead to undesired partial discharges in the glass tube or ark-overs outwardly of the discharge vessel, which occurs in particular during an ignition of the discharge lamp with a high frequency high voltage of several megahertz. These partial discharges outside the discharge vessel represent on one side a danger and lead on the other side to braking of the lamp ignition since it takes away the required ignition energy. It has been shown that a strong electrical field is formed in particular between the supply conductor and the return conductor near the base or in the region of the base under the influence of the high voltage. It is caused by the available air-filled space between the surface of the supply conductor and the inner surface of the glass tube, which space has a low electrical insulation action. Especially pronounced are these disturbing partial discharges during the operation of the discharge lamp with reduced outer air pressure, which as a rule occurs at great altitudes.

SUMMARY OF THE INVENTION

Accordingly, it is an object of present invention to provide a discharge lamp, in particular for vehicle illumination devices, which avoids the disadvantages of the prior art.

In keeping with these objects and with others which will become apparent hereinafter, one feature of present invention resides, briefly stated, in a discharge lamp in which the region of the burner in which the return conductor is guided on the supply conductor surrounded by the gas tube is formed so that the maximum electrical field intensity of an electrical field formed between the supply conductor and the return conductor in a space between the surface of the supply conductor and the inner surface of the surrounding glass tube is smaller than an ionization field intensity for air.

In accordance with another feature of the present invention, a distance at most equal to 0.7 mm is formed between the surface of the supply conductor and the inner surface of the surrounding glass tube by the air-filled space.

When the discharge lamp is designed in accordance with the present invention, it has the advantage that an electrical field formed between the supply conductor and the return conductor is weakened between the surface of the supply conductor and the inner surface of the glass tube and thereby the discharge lamp can be provided with a compact construction, or with the same construction the possible ignition voltage can be increased without the danger of partial discharges in the glass tube or ark-overs outside of the burner vessel and/or an operation of the discharge lamp is possible at a higher level without danger.

In accordance with another feature of the present invention, the space between the surface of the supply conductor and the inner surface of the glass tube is filled at least partially with electrically insulating material. With this feature, the air-filled space can be eliminated without changing the dimensions of the supply conductor or the glass tube, and the distance between the supply conductor and the inner surface of the surrounding glass tube can be small or eliminated at all.

In accordance with still a further feature of the present invention, the supply conductor has a conducting portion and a device composed of an electrically conductive material and arranged between the surface of the supply conductor and the inner surface of the glass tube in contact with the conducting portion, wherein the distance between the surface of the device and the inner surface of the glass tube determines the distance between the supply conductor and the inner surface of the glass tube. With this feature, the surface of the supply conductor is increased and thereby the distance between it and the inner surface of the glass tube is reduced or eliminated.

In accordance with a further feature of the present invention, the surface which limits the space toward the discharge vessel is arranged at least substantially perpendicular to the surface of the supply conductor. With this construction, an excess of the field intensity of an electrical field which is formed between the supply conductor and the return conductor in the region of the passage of the supply conductor to the discharge vessel is reduced. Therefore, the danger of partial discharges or ark-overs is reduced.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
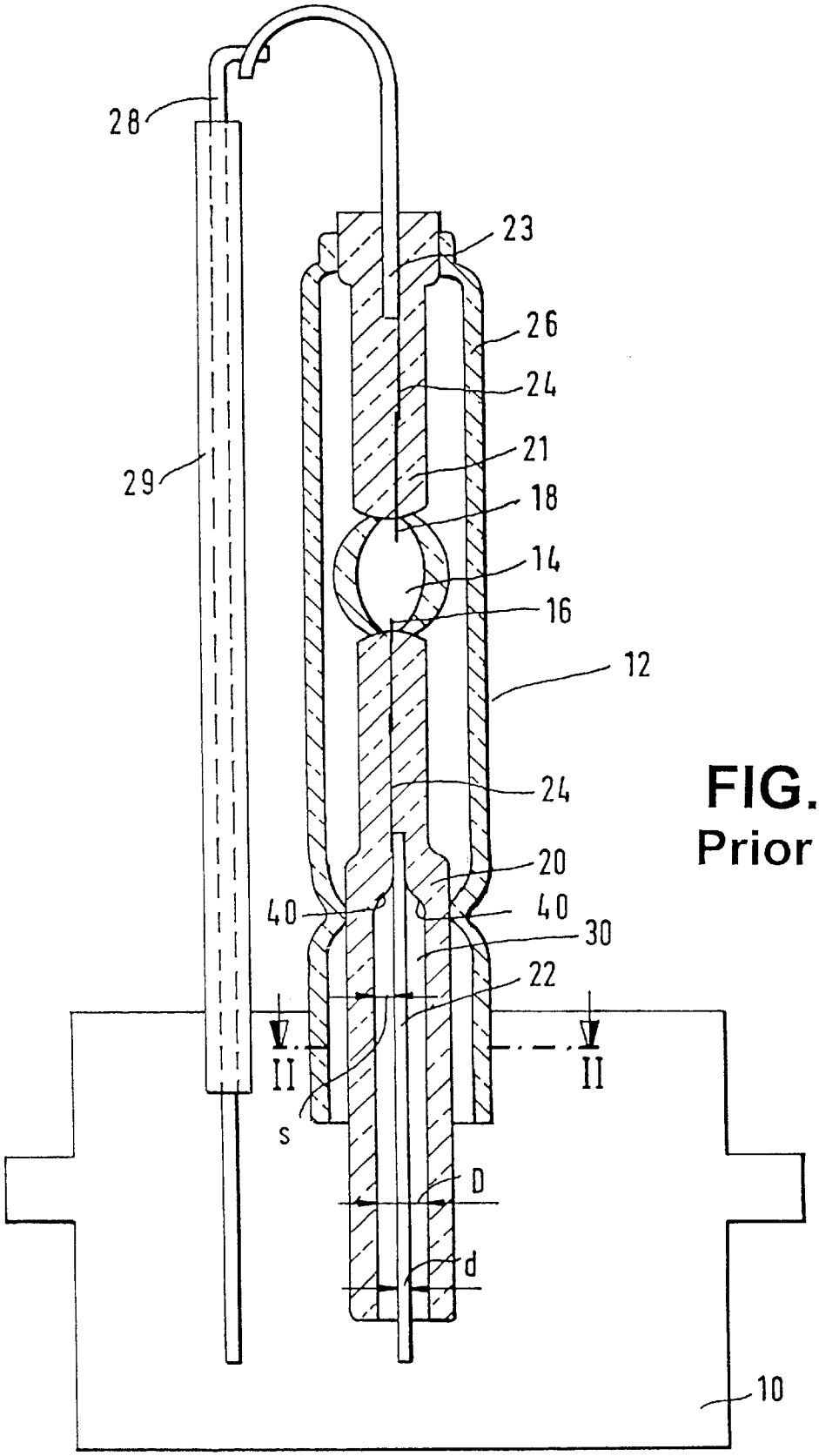
FIG. 1 Prior Art
FIG. 1 is a view showing a longitudinal section of a discharge lamp in accordance with the prior art.

A discharge lamp shown in FIGS. 1–9 is provided especially to be used in vehicle illumination devices, such as for example headlights. The discharge lamp has a base 10 which is shown in a substantially simplified manner. The base 10 can be formed of a plurality of parts and mounted in a reflector of the headlight, for example through an opening. A burner 12 is connected with the base 10, and a discharge vessel 13 is arranged in the burner. At least two electrodes 16, 18 are inserted in the discharge vessel 14 and have a filler of noble gas, for example xenon, and mercury, as well as in some cases metal halogenide.

The discharge vessel 14 has tubular projections 20, 21. A supply conductor 22 for the electrode 16 is arranged in the projection 20 which faces the base 10. A conductor 23 connected with the other electrode 18 is arranged in the projection 21 which faces away from the base 10. The discharge vessel 14 with the projections 20, 21 is composed of glass, for example quartz glass. A metal foil 24 is arranged for connection of the conductors 22, 23 with the electrodes 16, 18 between the conductors and the electrodes. It is composed preferably of molybdenum. The burner 12 can also have a glass tube 26 which surrounds the discharge vessel 14 with its projections 20, 21. The glass tube 26 on the one hand protects the discharge vessel 14 and on the other hand screens UV radiation produced during the operation of the discharge lamp. A return conductor 28 is connected with the conductor 23 and extends outside the discharge vessel 14 and outside the burner vessel 12. The return conductor 28 leads along the burner vessel 12 to the base 10 and is provided with an insulation 29. The supply conductor 22 to the electrode 16 and the return conductor 28 from the electrode 18 are connected each with a not shown plug contact on the base 10.

In the gas discharge lamp in accordance with the prior art shown in FIG. 1, an air-filled space 30 is provided in a region of the projection 20 near the base 10 between the surface of the supply conductor 22 and the inner surface of the projection 20 which forms there a hollow glass tube. The inner surface of the glass tube 20 extends toward the discharge vessel 14, for example by a squeezing of the same near the surface of the supply conductor 22, to provide a pressure-tight passage of the supply conductor 22 and the foil 24 to the discharge vessel 14. The supply conductor 23 is formed conventionally as a wire with a diameter d of substantially 0.4 mm, and the glass tube 20 has an inner diameter D of substantially 2 mm. Therefore, a distance s is provided through the air-filled space 30 of substantially 0.8 mm between the supply conductor 22 and the glass tube 20.

Figure 2:
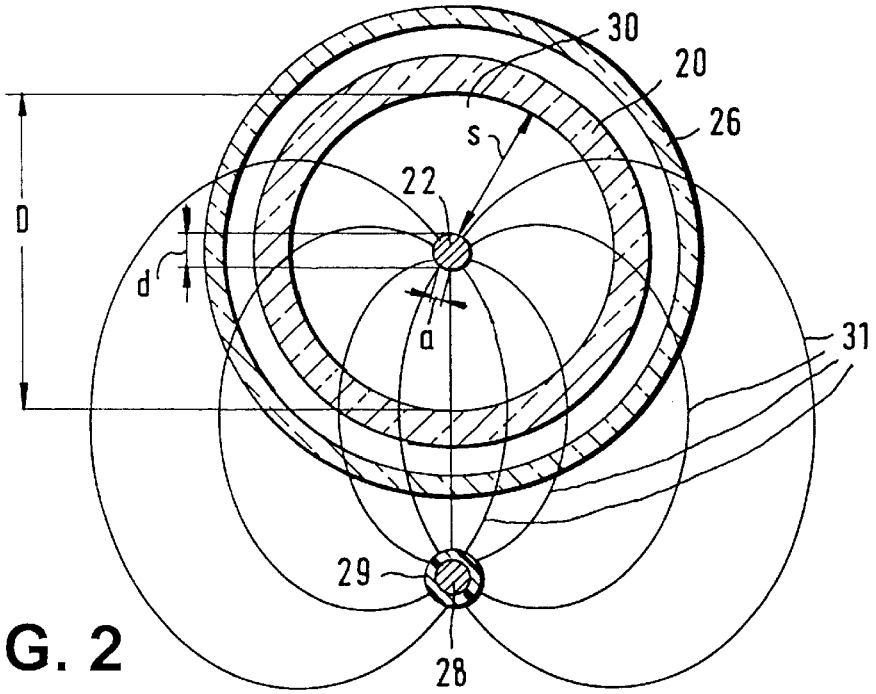
FIG. 2 Prior Art
FIG. 2 is a view showing a section of the discharge lamp of FIG. 1 taken along the line II—II.

FIG. 2 shows a cross-section of the projection 20. It shows the course of field lines 31 of an electrical field which is formed during the operation of the discharge lamp between the supply conductor 22 and the return conductor 28. In the region of the supply conductor 22 it has a high field intensity. The field line density which is a measure for the filled intensity and is characterized by the distance a of the field lines 21 is the highest at the side of the surface of the supply conductor 22 which faces the return conductor 28. It exceeds there under certain conditions the breakdown field intensity or the ionization field intensity of air. For the operation of the gas discharge lamp, an electrical pre-switching device is provided. It has an ignition part, through which the high frequency high voltage for ignition of the discharge lamp is produced and on which it is located. During this ignition process of the gas discharge lamp, the danger of partial ignitions of and/or ark-overs outside of the discharge vessel 14 is the greatest, and this danger in the case of low air pressure, for example at great altitude, is further increased.

Figure 3:
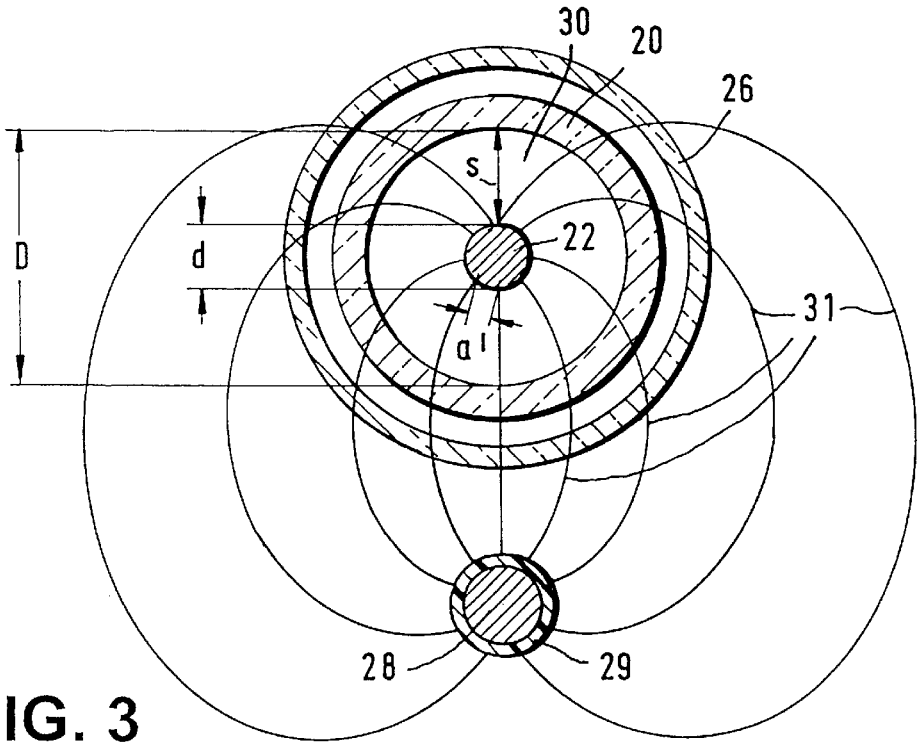
FIG. 3 is a view showing a cross-section along the line II—II of an inventive discharge lamp in accordance with a first embodiment.

FIG. 3 shows the inventive discharge lamp also in a cross-section. Here the diameter d of the supply conductor 22 is increased to a range between 0.6 mm and 1.4 mm. The inner diameter D of the glass tube 20 is unchanged and amounts to substantially 2 mm preferably, the diameter d of the supply conductor 22 amounts to substantially 0.8 mm to 1 mm. The distance between the surface of the supply conductor 22 and the inner surface of the glass tube 20 amounts correspondingly only to substantially from 0.7 mm to substantially 0.3 mm, preferably substantially from 0.6 mm to 0.5 mm. With a diameter d of the supply conductor 22 of substantially 1 mm, the electrical field intensity on the surface of the supply conductor 22 is substantially halved when compared to the embodiment with a diameter d of substantially 0.4 mm. Correspondingly the distance between the return conductor 28 and the supply conductor 22 can be reduced, or the ignition voltage applied for ignition of the discharge lamp can be increased by the factor 2 without ark-overs. FIG. 2 also shows the course of the filled lines 31 of the electrical field which is formed between the supply conductor 22 and the return conductor 28. When compared with FIG. 2, the lower electrical field intensity corresponding to the greater distance A' of the filled lines 31 can be clearly seen. The distance c between the surface of the supply conductor 22 and the inner surface of the glass tube 20 available by the air-filled space 30 is thereby reduced when compared with the distance lamp of the prior art shown in FIG. 2.

Figure 4:
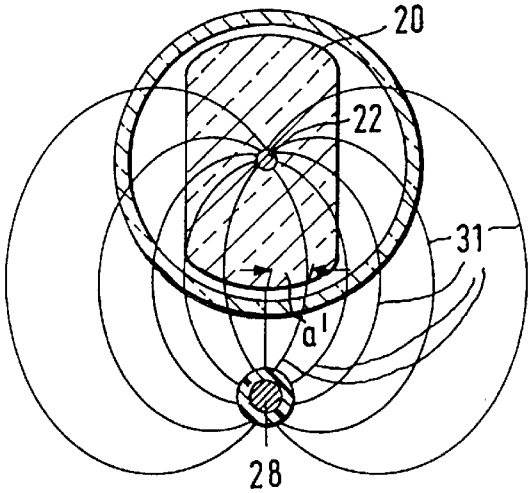
FIG. 4 is a view showing a cross-section along line II—II of a discharge lamp in accordance with a second embodiment.

FIG. 4 shows the inventive discharge lamp in accordance with a second embodiment in the cross-section. Here the inner diameter of the glass tube 20 is reduced relative to the discharge lamp in accordance with the prior art shown in FIG. 2. Preferably, the inner surface of the glass tube 20 is located on the surface of the supply conductor 22, so that there is no air-filled space between them and thereby there is no distance s provided by an air-filled space. This embodiment can be obtained by plastically deforming the glass tube 20 during the manufacture of the discharge lamp, in particular by compressing the same. The glass tube 20, as in the embodiments of FIGS. 1 and 2, can have a round cross-section or a substantial rectangular cross-section as shown in FIG. 4. The cross-sectional shape can be selected so that the glass tube 20 has a sufficient bending resistance for reliable holding of the burner vessel 20. In FIG. 4 again the field lines 31 of the electrical field during the operation of the discharge lamp between the supply conductor 22 and the return conductor 28 are shown. Also, it can be clearly seen that the distance A' between the field lines 31 is reduced when compared with FIG. 2. This makes possible a reduction of the distance between the return conductor 28 and the supply conductor 22 or an increase of the ignition voltage without the danger of the ark-overs.

Figure 5A:
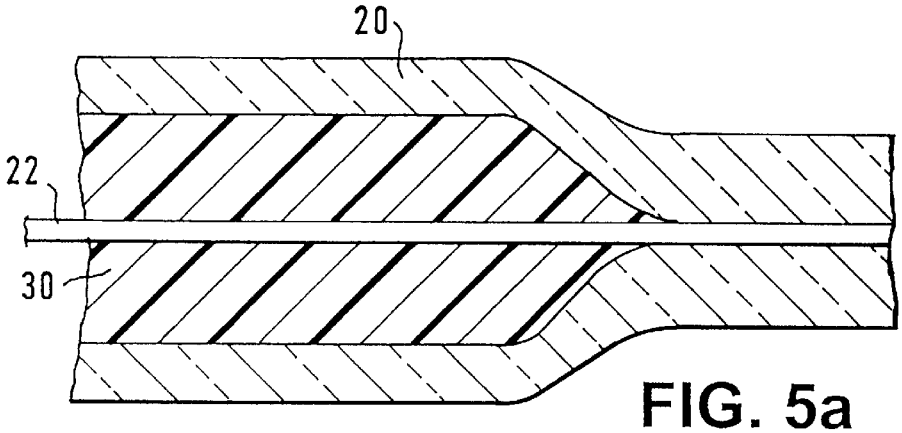
FIG. 5*a* is a view showing the inventive discharge lamp in accordance with a third embodiment in a longitudinal section, with a partial cut-out.
Figure 5B:
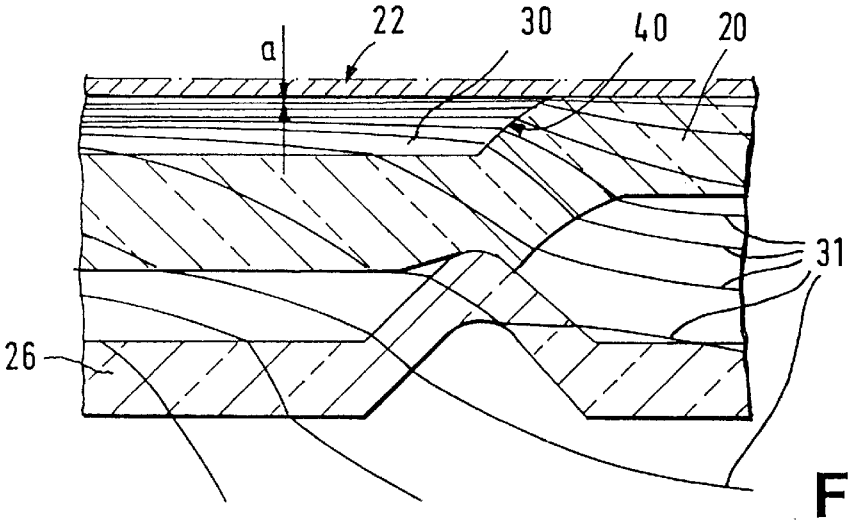
FIG. 5b Prior Art
FIG. 5*b* is a view showing a portion of a discharge lamp in accordance with the prior art.

FIG. 5*a* shows the inventive discharge lamp in accordance with a third embodiment. Here the space 30 between the surface of the supply conductor 22 and the inner surface of the glass tube 20 is at least partially filled with an electrically insulating material. In view of a simplified showing, the glass tube 26 and the return conductor 28 are not illustrated. The material can be for example a synthetic foam mass, for example silicon with which the space 30 is filled during the manufacture of the discharge lamp. Alternatively, the material can be a ceramic or glass-like mass which is introduced in the space 30 during the manufacture of the discharge lamp. Also, the mixture of different materials can be introduced into the space 30 as a filler.

The filler material can be preferably a material which has a dialectricity constant $\epsilon$ similar to quartz glass and amounting to substantially 2–5. Alternatively, also a non-conductive or partially conductive powder can be introduced into the space 30 and held in its position by a closure cap or a closure plug. This closure plug can be also produced from powder by its melting or bonding or by a mixing of a binder, for example adhesive or varnish. Alternatively, the supply conductor 22 can be provided with a casing applied on it and composed of electrically insulating material, and can be introduced into the glass tube 20 during the manufacture of the discharge lamp.

Figure 5C:
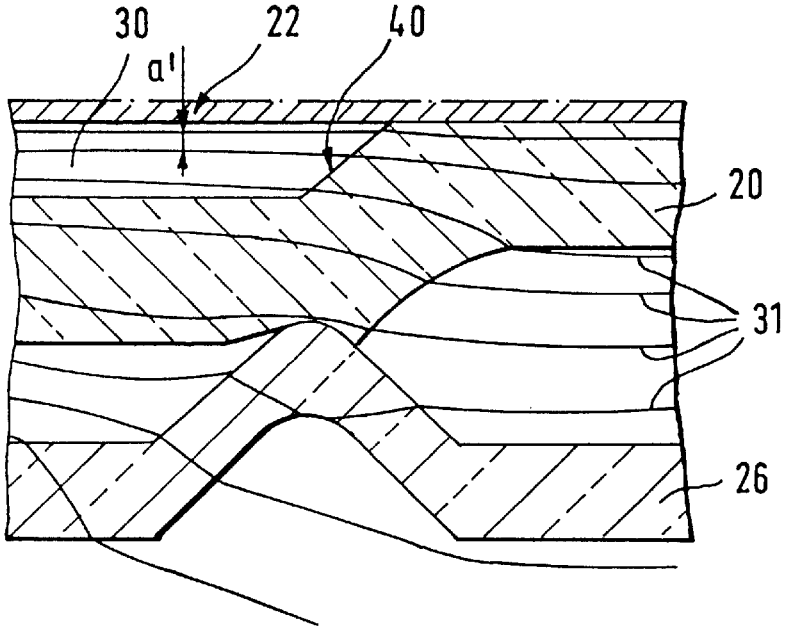
FIG. 5*c* is a view showing a portion of a variant of the discharge lamp in accordance with the third embodiment.

With the electrically insulating material arranged in the space 30, in all above illustrated embodiments, in accordance with a third embodiment again the distance between the surface and the supply conductor 22 and the inner surface of the glass tube 20 is reduced or completely eliminated by an air-field space, so that the filled intensity of an electrical field formed between the supply conductor 22 and the return conductor 28 in an air space is reduced. FIG. 5*c* shows a portion of the burner 12 of a varient of the discharge lamp. Here the space 30 is filled with glass powder with a grain size smaller than 100$\mu$. The field lines 31 extending downardly in the space 30 have a substantially greater distance A' than the distance A of the field lines 31 extending in FIG. 5 in a gas discharge lamp in accordance with the prior art in the air-filled space 30.

Figure 6:
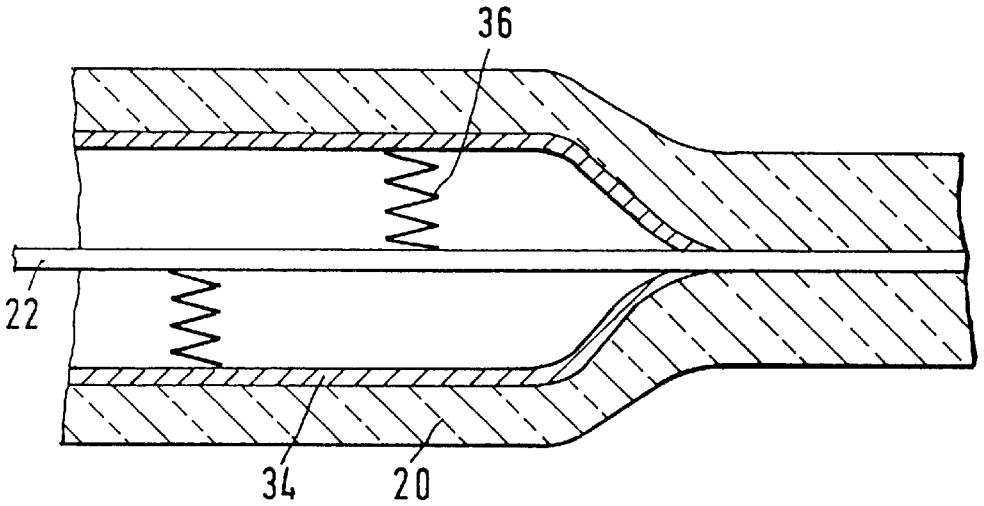
FIG. 6 is a view showing a longitudinal section of the discharge lamp in accordance with the fourth embodiment, with a partial cut-out.

FIG. 6 shows the inventive discharge lamp in accordance with a fourth embodiment. Here a device 34 of an electrically conductive material is arranged between the surface of a conductor portion 22 and the inner surface of the glass tube 20. It is electrically connected with the conductor portion 22. The conductor portion 22 is formed as a wire. In the embodiment shown in FIG. 6, the device 34 is formed as an electrically conductive coating applied on the inner surface of the glass tube 20. This coating 24 is applied during the manufacture of the glass tube 20 on the inner surface. It can be composed of metal, such as for example aluminum, chromium, tungsten, titanium, molybdenum, niobium, zinc, or silver or at least one alloy containing these metals. Alternatively, the coating 34 can be composed of another electrically conductive material, for example synthetic plastic material.

The coating 34 has a thickness of at least 100 angstrom and can be applied for example by sputtering on the inner surface of the glass tube 20. Alternatively, the coating 34 can be applied in dissolved or emulsified form, for example as liquid varnish. It can be burned-in, so that the solvent evaporates and only the electrically conductive material remains as the coating 34. Moreover, the inner surface of the glass tube 20 can be chemically treated so that an electrically conductive layer is produced on it. This can be obtained for example by a galvanic treatment of the inner surface. Alternatively, the device 34 can be formed for example as a sleeve of an electrically conductive material. The sleeve is inserted in the glass tube 20 between the surface of the wire 22 and the inner surface of the glass tube 20. The sleeve can be formed massive or formed as metal wicker or metal wool.

The electrical contacting of the wire 22 of the device 34 is formed preferably in the region of the pressure-tight passage of the wire 22 to the discharge vessel 14. Alternatively or additionally, a spring element 36 composed of electrically conductive material, in particular metal can be clamped between the wire 22 and the device 34 for electrical contacting. The springy element 36 can be formed for example as a pressure spring, a spiral spring, or a flat spring shown in FIG. 6. In all above described embodiments of the discharge lamp in accordance with the fourth embodiment, the device 34 forms by its electrical connection with the wire 22 a part of the supply conductor with the surface extending near the inner surface of the glass tube 20. Thereby also in the discharge lamp in accordance with the fourth embodiment, a distance between the surface of the supply conduit composed of the wire 22 and the device 34, and the inner surface of the glass tube 20, provided by an air-filled space is retained low or is not available. Therefore, no partial discharges can form in the glass tube 20 even with high ignition voltage.

Figure 7:
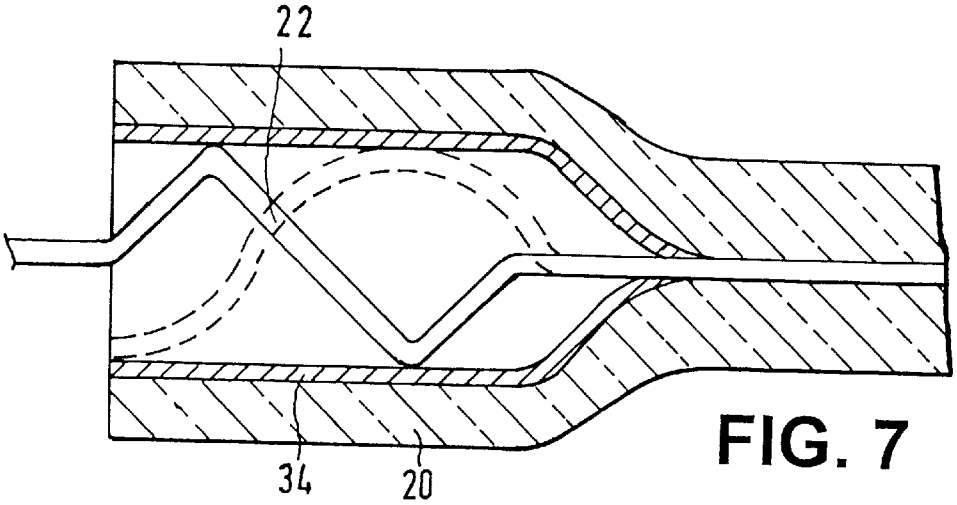
FIG. 7 is a view showing a modified embodiment of the inventive discharge lamp of FIG. 6.

FIG. 7 shows an embodiment of the discharge lamp which substantially corresponds to the embodiment of FIG. 6. However, the electrical contacting of the wire 22 of the device 24 is modified. The wire 22 extends at least over a part of its length in the glass tube 20 in zig-zag shape. Therefore, at least at one point, preferably at several points, it abuts against the device 34 under pressure and contacts with it. In addition the wire 22 can contact the device 34 as described in FIG. 6, in the region of its pressure-tight passage through the glass tube 20 to the discharge vessel 14. Alternatively, the wire 22 can be bent to have a wavy shape as shown in FIG. 7 in broken lines, and therefore can abut on one or several points against the device 34 under pressure.

Figure 8:
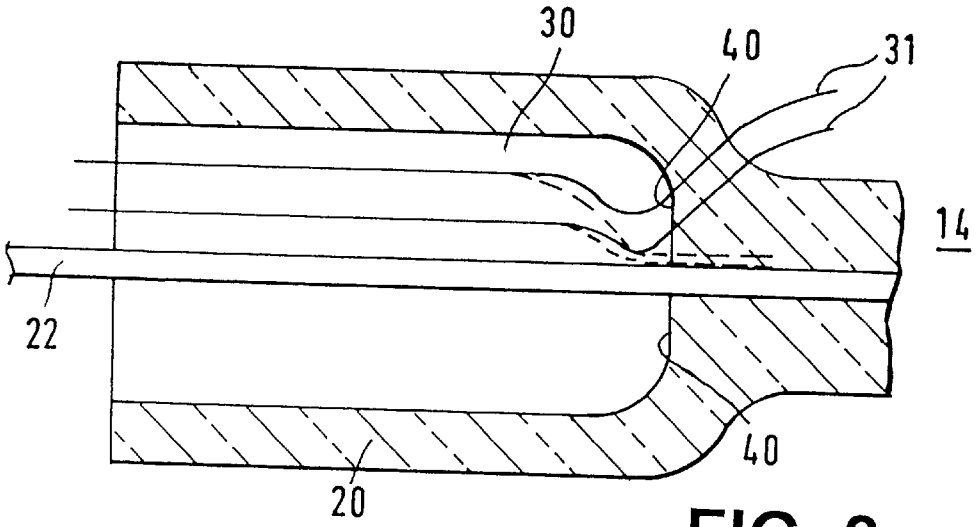
FIG. 8 is a view showing a discharge lamp in accordance with a fifth embodiment in a longitudinal section, with a partial cut-out.

FIG. 8 shows the inventive gas discharge lamp in accordance with a fifth embodiment. An air-filled space 30 can be available between the surface of the supply conductor 22 and the inner surface of the glass tube 20 in correspondence with discharge lamps in accordance with the prior art shown in FIGS. 1 and 2, or the air filled space can be reduced or completely eliminated as in the previous embodiments. In the embodiment of the discharge lamp corresponding to the prior art of FIG. 2 the space 30 reduces for the pressure-tight passage of the supply conductor 22 to the discharge vessel 14 in a wedge-like manner. Therefore, limiting surfaces 40 are inclined at an acute angle to the discharge vessel 14 toward the surface of the supply conductor 22. It has been shown that by this arrangement of the limiting surfaces 40 a strong magnification of the field intensity of the forming electrical field in this region is caused. The course of the filled lines 31 in this case is shown in FIG. 8 in broken lines. In the embodiment of the inventive discharge lamp corresponding to the fifth embodiment of FIG. 5, the limiting surfaces 40 which limit the space 30 toward the discharge vessel 13 are at least approximately perpendicular to the surface of the supply conductor 22. Thereby a small magnification of the field intensity is provided when compared with FIG. 2, which can be visible by dense course of the field lines 31 in this region.

Figure 1A:
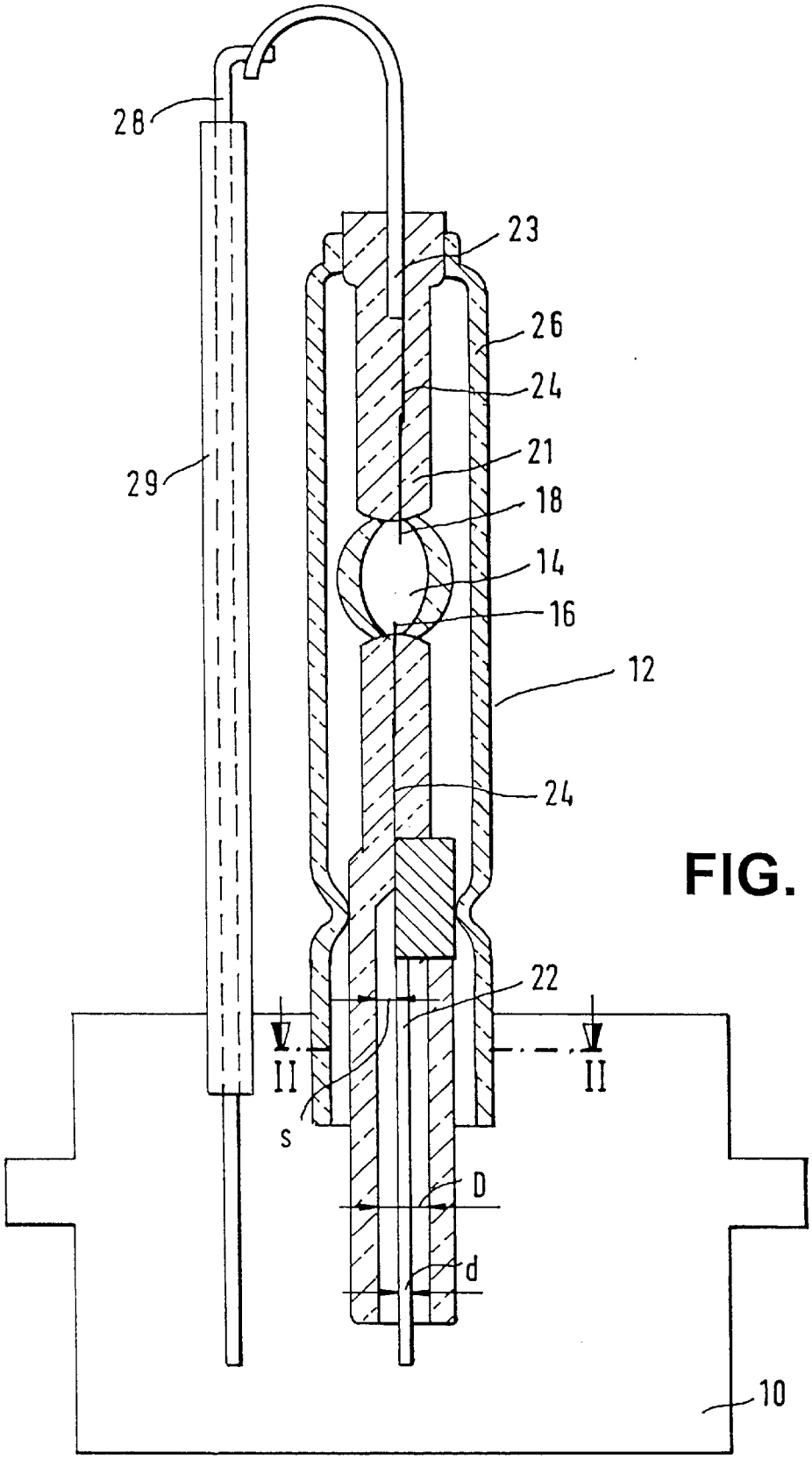
FIGS. 1*a*, 1*b*, 1*c* are views showing details of the discharge lamp in accordance with the present invention.
Figure 1B:
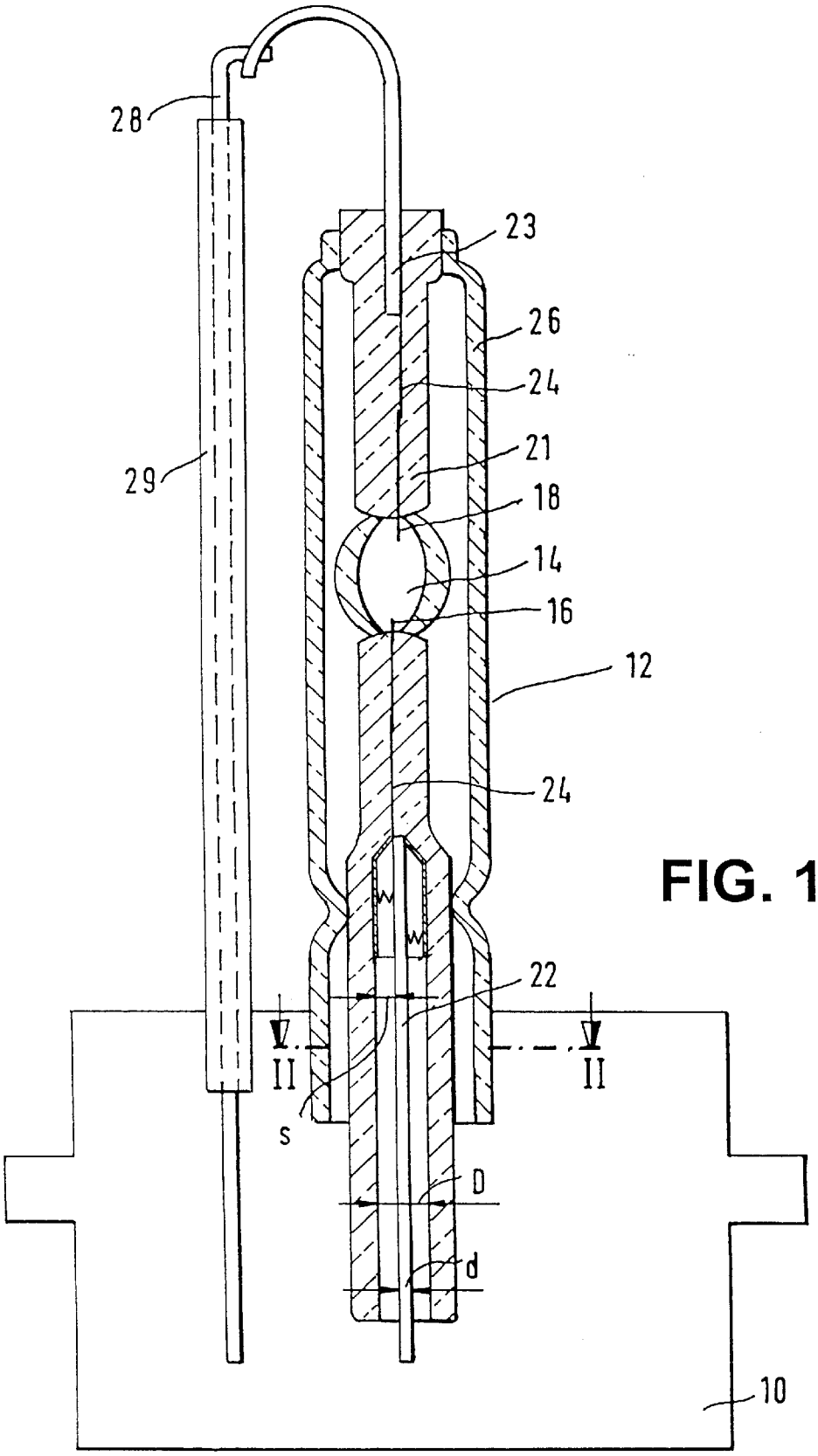
Figure 1C:
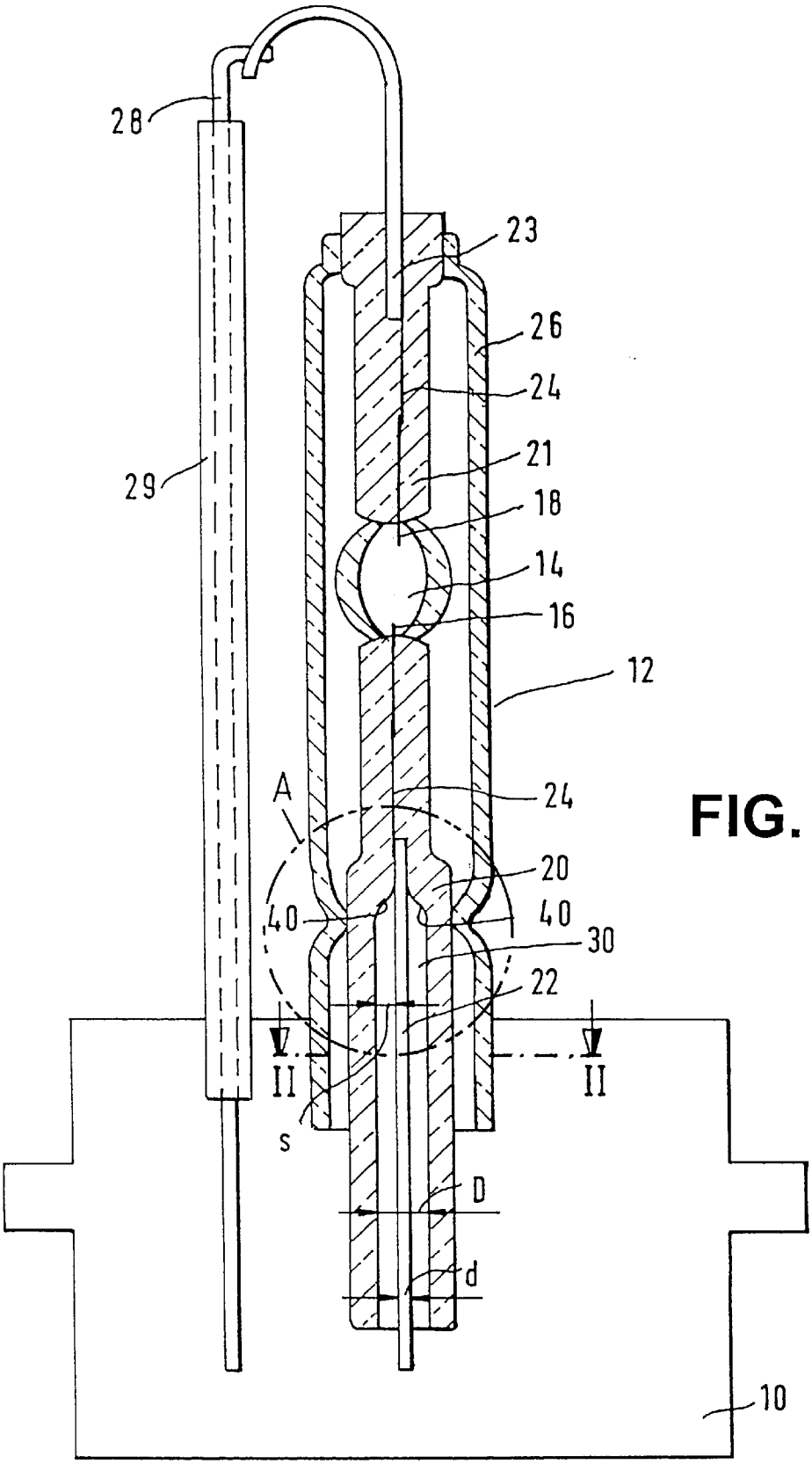
Figure 9:
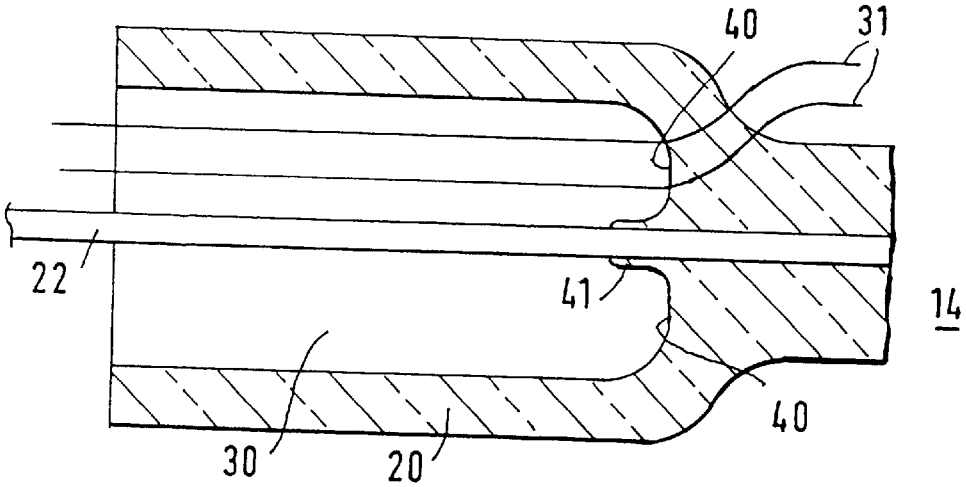
FIG. 9 is a view showing a modified embodiment of the discharge lamp of FIG. 8.

FIG. 9 shows a modified embodiment of the discharge lamp of FIG. 8. Here in addition, starting from the limiting surfaces 40 of the pressure-tight passage, a projection 41 surrounding the supply conductor 22 is provided. It extends into the space 30. Thereby a further reduction of the magnification of the field intensity is obtained. This again can be seen by a less denser course of the filled lines 31 in this region when compared with FIG. 8. FIGS. 1*a,* 1*b,* 1*c* are views showing the details of FIGS. 5*c,* 6, 7, or 9 with the overview of FIG. 1.

The above described features in the discharge lamp in accordance with the embodiments from 1 to 5 can be realized individually, but it is to be understood that also combinations of these features can be used as well.

It will be understood that each of the elements described above, or two or more together, may also find a useful application in other types of constructions differing from the types described above.

While the invention has been illustrated and described as embodied in discharge, in particular for vehicle illumination devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A discharge lamp for vehicle illumination devices, comprising a base; a burner connected with the base and having a discharge vessel with at least two electrodes; electrical conductors connected with said electrodes and leading to said base, said electrical conductors including a supply conductor extending to one of said electrodes in said burner and surrounded by a glass tube and a return conductor extending from another of said electrodes outside said burner, said burner having a region in which said return conductor is guided along said supply conductor surrounded by said glass tube, said region being formed so that a maximum electrical field intensity of an electrical field formed between said supply conductor and said return conductor in a space between a surface of said supply conductor and the inner surface of said glass tube is lower than an ionization field intensity for air.

2. A discharge lamp as defined in claim 1, wherein said space is air filled and formed so that a distance provided by said space is at least approximately zero.

3. A discharge lamp as defined in claim 1, wherein said gas tube has an inner diameter of substantially 2–3 mm, said supply conductor having a diameter of substantially 0.6–1.4 mm.

4. A discharge lamp as defined in claim 1, wherein said space provided between said surface of said supply conductor and said inner surface of said gas tube is at least partially filled with an electrically insulating material.

5. A discharge lamp as defined in claim 1, wherein said supply conductor has a conductive portion and a device arranged between said surface of said supply conductor and said inner surface of said glass tube, said device being composed of an electrically conductive material and contacting with said conductive portion, said surface of said supply conductor being a surface of said device, so that a distance is provided between said surface of said device and said inner surface of said glass tube.

6. A discharge lamp as defined in claim 5, wherein said device is formed as a coating provided on said inner surface of said glass tube and composed of an electrically conductive material.

7. A discharge lamp as defined in claim 5, wherein said conductive portion is arranged so that a contacting of said conductive portion of said device is performed at least near a passage of said conductive portion into said discharge vessel.

8. A discharge lamp as defined in claim 5; and further comprising an electrically conductive springy element which abuts against said conductive portion and said device so as to provide electrical contact of said conductive portion with said device.

9. A discharge lamp as defined in claim 5, wherein said conductive portion is at least locally bent so that it contacts said device inside said gas tube at least in one point.

10. A discharge lamp as defined in claim 1; and further comprising means forming a limiting surface which limits said space toward said discharge vessel and is arranged at least approximately perpendicular to said surface of said supply conductor.

11. A discharge lamp as defined in claim 9; and further comprising a projection which extends from said limiting surface in said space and surrounds said supply conductor at least over a part of its periphery and over a part of its length.

12. A discharge lamp for vehicle illumination devices, comprising a base; a burner connected with said base and having a discharge vessel with at least two electrodes; electrical conductors connected with said electrodes and leading to said base, said electrical conductors including a supply conductor which extends to one of said electrodes in said burner and is surrounded by a glass tube and a return conductor from which another of said electrodes extends outside of said burner, said conductors being arranged so that between a surface of said supply conductor and an inner surface of said glass tube a distance is formed by an air-filled space and amounts to at most 0.7 mm.

13. A discharge lamp as defined in claim 12, wherein said distance provided by said air-filled space is at least approximately zero.

14. A discharge lamp as defined in claim 12, wherein said glass tube has an inner diameter of substantially 2–3 mm, said supply conductor having a diameter of substantially 0.6–1.4 mm.

15. A discharge lamp as defined in claim 12, wherein said space provided between said surface of said supply conductor and said inner surface of said gas tube is at least partially filled with an electrically insulating material.

16. A discharge lamp as defined in claim 12, wherein said supply conductor has a conductive portion and a device arranged between said surface of said supply conductor and said inner surface of said glass tube, said device being composed of an electrically conductive material and contacting with said conductive portion, said surface of said supply conductor being a surface of said device, so that a distance is provided between said surface of said device and said inner surface of said glass tube.

17. A discharge lamp as defined in claim 16, wherein said device is formed as a coating provided on said inner surface of said glass tube and composed of an electrically conductive material.

18. A discharge lamp as defined in claim 16, wherein said conductive portion is arranged so that a contacting of said conductive portion of said device is performed at least near a passage of said conductive portion to said discharge vessel.

19. A discharge lamp as defined in claim 16; and further comprising an electrically conductive springy element which abuts against said conductive portion and said device so as to provide electrical contact of said conductive portion with said device.

20. A discharge lamp as defined in claim 16, wherein said conductive portion is at least locally bent so that it contacts said device inside said gas tube at least in one point.

21. A discharge lamp as defined in claim 12; and further comprising means forming a limiting surface which limits said space toward said discharge vessel and is arranged at least approximately perpendicular to said surface of said supply conductor.

22. A discharge lamp as defined in claim 21; and further comprising a projection which extends from said limiting surface in said space and surrounds said supply conductive at least over a part of its periphery and over a part of its length.

* * * * *